US005906870A

United States Patent [19]

Lo

[11] Patent Number: 5,906,870

[45] Date of Patent: May 25, 1999

[54] ELECTRIC ROTARY DECORATION

[76] Inventor: Szu Wei Lo, 7 F-1, No. 3 Lane, 173 Liu-Ho Road, Pu-Li chen, Nan-Tou Hsien, Taiwan

[21] Appl. No.: 08/998,580

[22] Filed: Dec. 29, 1997

[51] Int. Cl.[6] ..... B44C 3/06

[52] U.S. Cl. ..... 428/16; 428/542.2

[58] Field of Search ..... 428/7, 16, 542.2

[56] References Cited

U.S. PATENT DOCUMENTS

| | | | |
|---|---|---|---|
| 4,753,436 | 6/1988 | Sinclair | 446/238 X |
| 5,081,899 | 1/1992 | Hou | 428/16 X |
| 5,182,144 | 1/1993 | Hou | 428/16 |
| 5,332,364 | 7/1994 | Rodarmer | 428/16 X |
| 5,617,658 | 4/1997 | Chen | 40/411 |

*Primary Examiner*—Henry F. Epstein
*Attorney, Agent, or Firm*—Rosenberg, Klein & Bilker

[57] ABSTRACT

An electric rotary decoration including a fixing frame assembly, a rotary mechanism and a driving mechanism. The rotary mechanism includes a central rotary shaft, an upper rotary disc, a lower rotary disc and multiple vertically movable member. When the driving mechanism drives the rotary mechanism to rotate, the multiple slide rods not only are rotated but also are moved up and down according to the predetermined curved path of the guide board in contact with the upper ends of the slide rods. Therefore, the decorative articles create a live visual effect.

2 Claims, 3 Drawing Sheets

ELECTRIC ROTARY DECORATION

BACKGROUND OF THE INVENTION

The present invention relates to an electric rotary decoration in which the decorative articles not only are rotated but also are moved up and down.

FIG. 1 shows an existing carrousel decoration including a base seat 11, a central rotary disc 12, multiple vertical rods 13 disposed on the central rotary disc 12 and multiple horse-like decorative articles 14 disposed on the vertical rods 13. When the central rotary disc 12 is rotated, the horse-like decorative articles 14 are rotated along therewith. However, these decorative articles 14 cannot be moved up and down. Therefore, only a monotonous visual effect is provided.

SUMMARY OF THE INVENTION

It is therefore a primary object of the present invention to provide an electric rotary decoration in which the decorative articles not only are rotated but also are moved up and down to create a live visual effect.

It is a further object of the present invention to provide the above electric rotary decoration including an inner annular guide board and an outer annular guide board with different curved paths so as to create two kinds of up and down running or jumping states of the adjacent decorative articles such as toy horses.

According to the above objects, the electric rotary decoration of the present invention includes:

a fixing frame assembly including a base seat, a top cover and multiple support columns connecting and fixing the top cover with the base seat, a lower surface of the top cover being disposed with at least one annular guide board with a certain curved path;

a rotary mechanism including:

(a) a central rotary shaft which is upright located, a top end and a bottom end of the rotary shaft being respectively rotatably disposed on the top cover and the base seat, a tooth section being formed near the bottom end of the rotary shaft;

(b) an upper rotary disc which is horizontally secured at a predetermined position of an upper half of the rotary shaft, the upper rotary disc being formed with multiple upper holes;

(c) a lower rotary disc which is horizontally secured at a predetermined position of a lower half of the rotary shaft, the lower rotary disc being formed with multiple lower holes corresponding to the upper holes; and (d) multiple vertically movable member each having a slide rod, a spring, a spring seat and a decorative article, the slide rods being passed through the upper and lower holes, an upper end of the slide rod contacting with the guide board, a lower end of the slide rod contacting with the spring, the spring being installed in the spring seat which is secured on the lower rotary disc; and a driving mechanism including an electric motor and a driving gear set engaged with the tooth section for rotarily driving the rotary mechanism. When the driving mechanism drives the rotary mechanism to rotate, the multiple slide rods not only are rotated but also are moved up and down according to the predetermined curved path of the guide board in contact with the upper ends of the slide rods and the decorative articles create a live visual effect.

The present invention can be best understood through the following description and accompanying drawings, wherein:

DETAILED DESCRIPTION OF THE PREFERRED EMBODIMENTS

Figure 1:
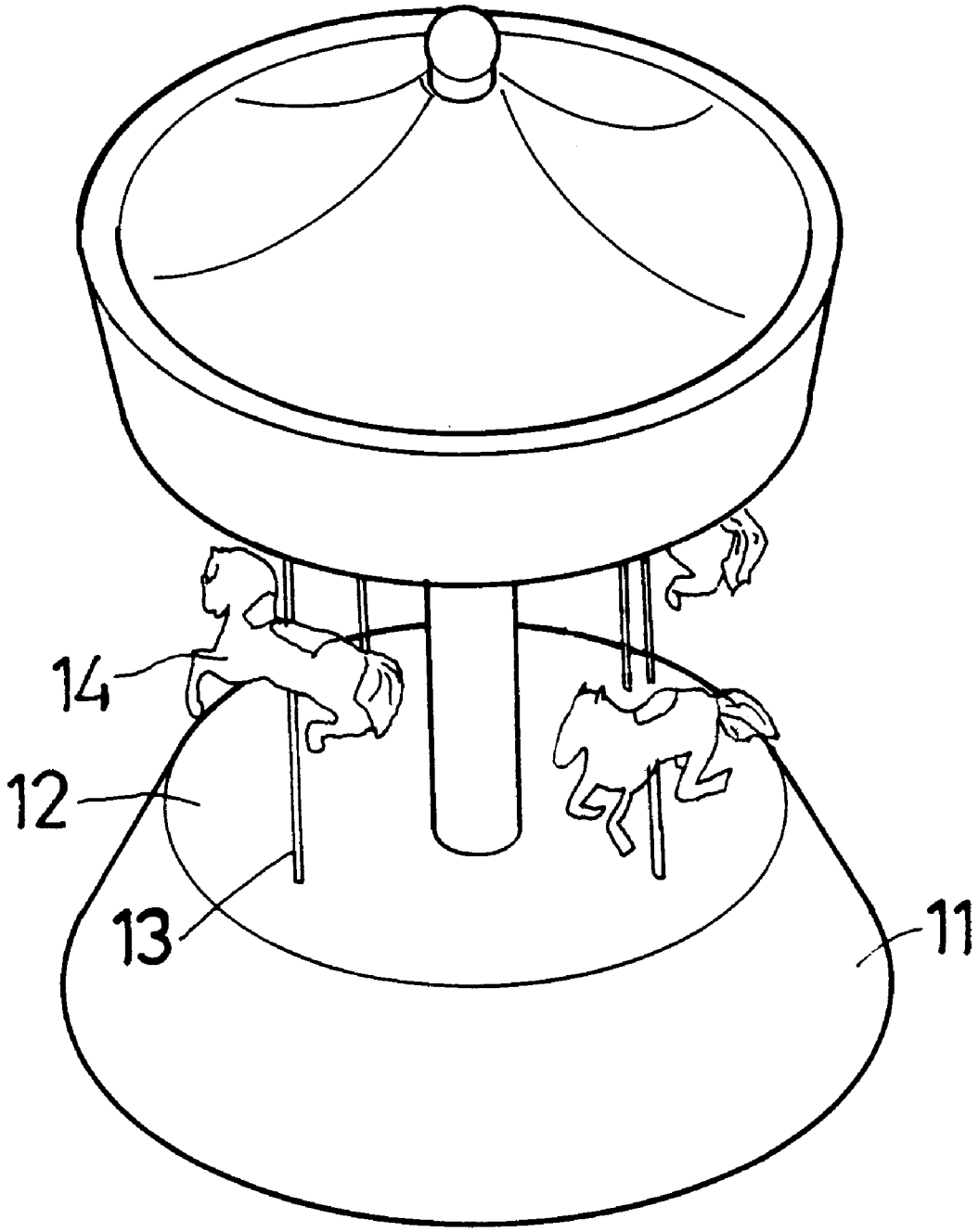
FIG. 1 PRIOR ART
FIG. 1 is a perspective view of a conventional carrousel decoration.
Figure 2:
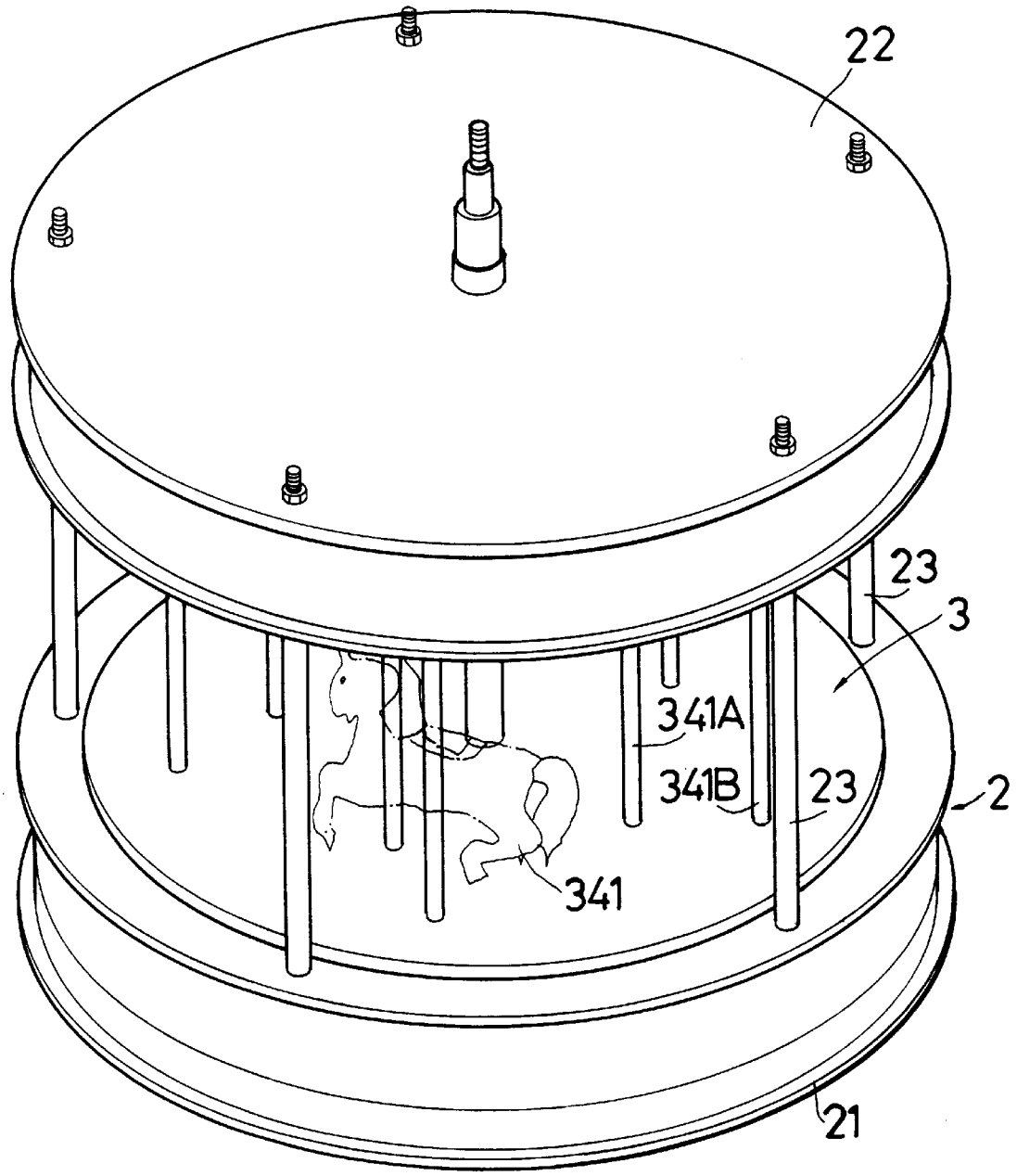
FIG. 2 is a perspective view of the present invention.
Figure 3:
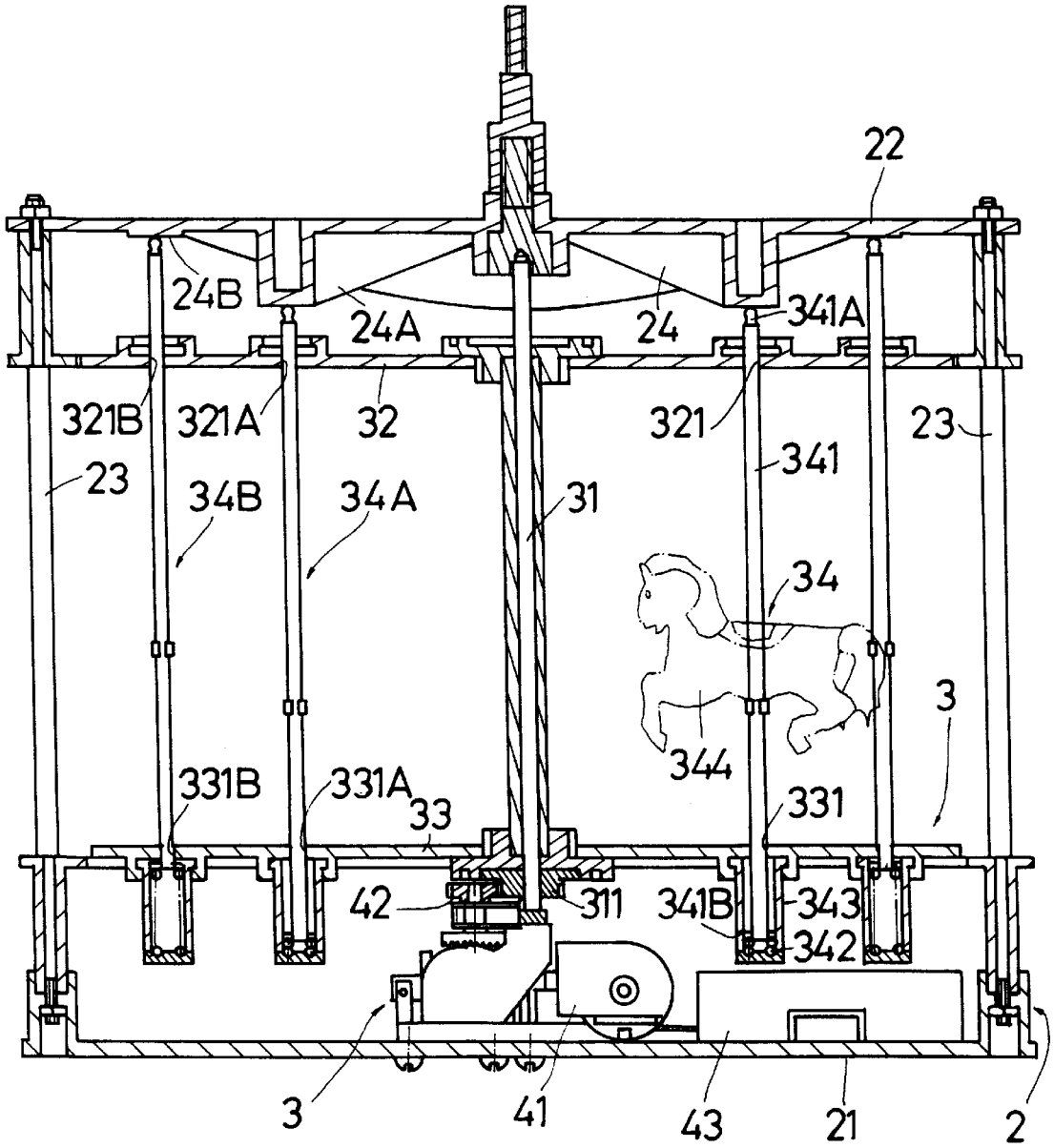
FIG. 3 is a sectional view of the present invention.

Please refer to FIGS. 2 and 3. The electric rotary decoration of the present invention includes a fixing frame assembly 2, a rotary mechanism 3 and a driving mechanism 4.

The fixing frame assembly 2 includes a base seat 21, a top cover 22 and multiple support columns 23 connecting and fixing the top cover 22 with the base seat 21. A lower surface of the top cover 22 is disposed with at least one annular guide board 24 with a certain curved path.

The rotary mechanism 3 includes:

(a) a central rotary shaft 31 which is upright located, a top end and a bottom end of the rotary shaft being respectively rotatably disposed on the top cover 22 and the base seat 21, a tooth section 311 being formed near the bottom end of the rotary shaft 31;

(b) an upper rotary disc 32 which is horizontally secured at a predetermined position of an upper half of the rotary shaft 31, the upper rotary disc 32 being formed with multiple upper holes 321;

(c) a lower rotary disc 33 which is horizontally secured at a predetermined position of a lower half of the rotary shaft 31, the lower rotary disc 33 being formed with multiple lower holes 331 corresponding to the upper holes 321; and (d) multiple vertically movable member 34 each having a slide rod 341, a spring 342, a spring seat 343 and a decorative article 344. An upper end 341A of the slide rod 341 contacts with the guide board 24. A lower end 341B of the slide rod 341 contacts with the spring 342. The spring 342 is installed in the spring seat 343 which is secured on the lower rotary disc 33.

The driving mechanism 4 includes an electric motor 41 and a driving gear set 42 engaged with the tooth section 311 for rotarily driving the rotary mechanism 3.

Accordingly, when the driving mechanism 4 drives the rotary mechanism 3 to rotate, the multiple slide rods 341 not only are rotated but also are moved up and down according to the predetermined curved path of the guide board 24 in contact with the upper ends 341A of the slide rods 341. Therefore, the decorative articles 344 create a live visual effect.

The above embodiment can be modified without departing from the spirit of the present invention. For example, the driving mechanism 4 can further include a cell (or battery) 43 for supplying power for the motor 41.

In addition, the annular guide board 24 includes an inner annular guide board 24A and an outer annular guide board 24B with various high and low paths.

The multiple upper holes 321 include multiple inner annularly arranged and outer annularly arranged upper holes 321A and 321B.

The multiple lower holes 331 include multiple inner annularly arranged and outer annularly arranged lower holes 331A and 331B.

The multiple vertically movable members 34 include multiple inner annularly arranged vertically movable members 34A and outer annularly arranged vertically movable members 34B which are respectively passed through the inner and outer annularly arranged upper and lower holes 321A, 331A, 321B, 331B to contact with the inner and outer annular guide boards 24A, 24B.

It is to be understood that the above description and drawings are only used for illustrating some embodiments of the present invention, not intended to limit the scope thereof. Any variation and derivation from the above description and drawings should be included in the scope of the present invention.

What is claimed is:

1. An electric rotary decoration comprising:

a fixing frame assembly, said fixing frame assembly including a base seat, a top cover spaced above said base seat, and a plurality of support columns connecting and fixing said top cover to said base seat, said top cover having at least one annular guide board formed on a lower surface of said top cover, said annular guide board having a predetermined arcuate path;

a rotary mechanism coupled to said base seat, said rotary mechanism including:

(a) an upright centrally disposed rotary shaft having an upper and rotatively coupled to said top cover and a bottom end rotatively coupled to said base seat, said rotary shaft having a tooth section formed adjacent said bottom end of said rotary shaft;

(b) am upper rotary disc horizontally secured to said rotary shaft adjacent said upper end thereof, said upper rotary disc having a multiplicity of upper holes formed therethrough;

(c) a lower rotary disc horizontally secured to said rotary shaft adjacent said bottom end thereof, said lower rotary disc having a multiplicity of lower holes formed therethrough, said lower holes being located in respective correspondence with said upper holes; and (d) a plurality of vertically movable members, each of said plurality of vertically movable members having a slide rod passing through a corresponding pair of said upper and lower holes rotative displacement therewith, a spring seat coupled to a lower surface of said lower rotary disc, a spring disposed in said spring seat and contacting a lower end of said slide rod, and a decorative article coupled to said slide rod for displacement therewith, each of said slide rods having an upper and contacting said guide board; and, a driving mechanism secured to said base seat, said driving mechanism including an electric motor and a driving gear set engaged with said tooth section for rotatively driving said rotary mechanism, whereby said rotary mechanism is driven to rotate and said slide rods are moved up and down in accordance with said predetermined arcuate path of said guide board as said slide rods are rotatively displaced with said upper and lower rotary discs.

2. The electric rotary decoration as claimed in claim 1, wherein said top cover includes an inner annular guide board and an outer annular guide board, each of said inner and outer annular guide boards having respective arcuate paths with high and low portions.

* * * * *